US006405405B1

(12) United States Patent
Hauch

(10) Patent No.: US 6,405,405 B1
(45) Date of Patent: Jun. 18, 2002

(54) PRODUCT CLEANER WITH AIR FLOW CONTROL

(75) Inventor: David A. Hauch, Afton, MN (US)

(73) Assignee: Carter Day International, Inc., Minneapolis, MN (US)

( * ) Notice: Subject to any disclaimer, the term of this patent is extended or adjusted under 35 U.S.C. 154(b) by 0 days.

(21) Appl. No.: 09/553,218

(22) Filed: Apr. 20, 2000

(51) Int. Cl.[7] ..... B08B 5/02

(52) U.S. Cl. ..... 15/309.2; 15/345; 209/136; 209/644

(58) Field of Search ..... 15/309.2, 345; 209/644, 134, 135, 136, 137

(56) References Cited

U.S. PATENT DOCUMENTS 1,506,494 A * 8/1924 Lindsay ..... 209/137
2,222,861 A * 11/1940 Stoner ..... 209/135
2,493,218 A * 1/1950 Bergstrom ..... 209/135 X
3,909,873 A * 10/1975 Minasov et al. ..... 15/309.2
4,568,453 A * 2/1986 Lowe ..... 209/135
4,631,124 A * 12/1986 Paulson ..... 209/134 X
4,865,721 A * 9/1989 Smith et al. ..... 209/135

* cited by examiner

*Primary Examiner*—Chris K. Moore
(74) *Attorney, Agent, or Firm*—Briggs and MOrgan, PA

(57) ABSTRACT

The present invention provides a vertical drop, multi-pass product cleaner with air flow control on the outlet side of the cleaner, wherein the air flow control includes dampers movable between open and constricted positions disposed within at least one of a plurality of air outlets of the product cleaner.

10 Claims, 4 Drawing Sheets

PRODUCT CLEANER WITH AIR FLOW CONTROL

FIELD OF THE INVENTION

The present invention relates generally to machines and other apparatus and to processes used to clean dirty product of fines and other undesirable particulate matter and specifically to machines and processes incorporating a vertical drop through an upward air flow therethrough and through a plurality of transverse air flows therethrough that remove the fines and/or foreign matter present in the product therefrom.

BACKGROUND OF THE PRESENT INVENTION

Product cleaning to remove fines and other undesirable materials is a well known and long used process. A variety of machines are used for this purpose. One type involves the use of rotating screens to sort or filter the desirable from the undesirable product. Another type involves the use of an air flow through the falling product to blow away light weight fines and other undesirable materials.

An example of the latter type of product cleaner, also called an aspirator, is shown in U.S. Pat. No. 5,685,434 to Ackerman, which is assigned to the same assignee as the present invention, and which is commonly referred to as a vertical drop, multi-pass cleaner. As shown in that patent, a product stream including fines and other undesirable material is introduced into the product cleaner. The product stream flows downward under the influence of gravity and an upward and transverse moving air flow blows the lighter fines and undesirable particulate matter out of the product stream. One of the features disclosed in the Ackerman '434 patent is the use of flow control dampers on the inlet side of the air flow path in an attempt to regulate the air flow entering the product cleaner at various points along the path of the downwardly falling product stream. The goal in doing so is to control the air flow substantially equally through out the downward falling path of the product to be cleaned.

It has been found that providing a means for controlling the air flow entering the cleaner does not, in fact, afford the desired ability to control the airflow.

It would be desirable to have a product cleaner that enabled the operator to precisely control the transverse airflows.

SUMMARY OF THE INVENTION

It is an object of the present invention to provide new and improved apparatus that is not subject to the foregoing disadvantages.

It is yet another object of the present invention to provide a vertical drop cleaner that enables the operator to control the air flow, particularly the substantially transverse air flows, through the free flowing product.

The foregoing objects of the present invention are provided by an improved product cleaner including a vertical upward and transverse airflows to remove fines and other undesirable particulates from the product. An apparatus in accord with the present invention includes a product inlet and a product outlet disposed substantially therebelow. The apparatus further includes a plurality of transverse airflow inlets and a plurality of transverse airflow outlets with the outlets including a plurality of individually movable dampers that open and close the outlets for the individual control of the airflow through each outlet.

The foregoing objects of the invention will become apparent to those skilled in the art when the following detailed description of the invention is read in conjunction with the accompanying drawings and claims. Throughout the drawings, like numerals refer to similar or identical parts.

DETAILED DESCRIPTION OF THE INVENTION

Figure 1:
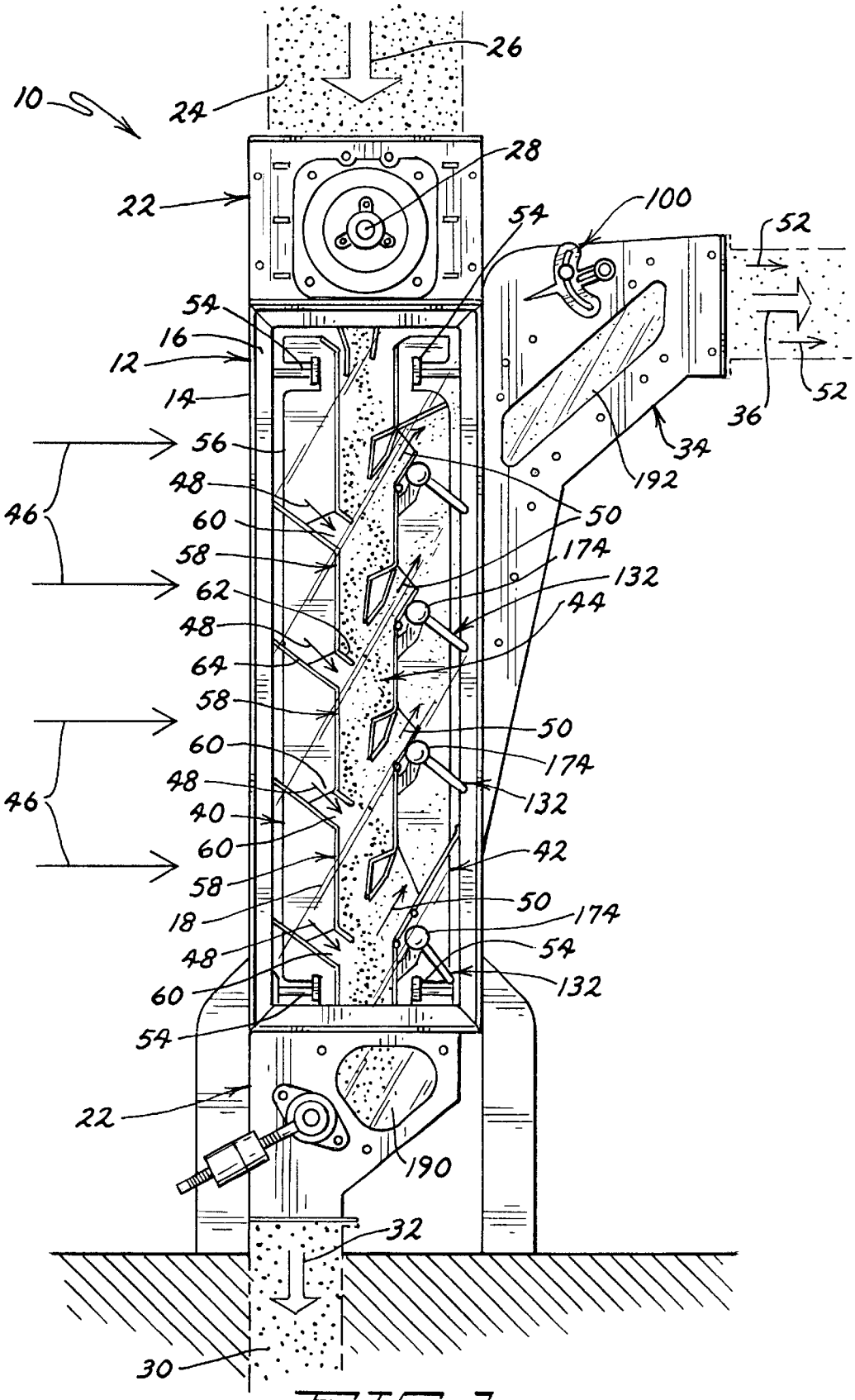
FIG. 1 is a side elevation view of a product cleaner in accord with the present invention.

FIG. 1 illustrates a product cleaner 10 in accord with the present invention. The cleaner 10 operates generally by accepting a downward flow of dirty product from a product supply and separating the desired, clean product from the undesirable material with the use of transverse and upwardly directed airflows. The airflows blow the undesirable contaminant materials out of the cleaner 10 through an exhaust while the cleaned product falls downward under gravitational influence and out of the cleaner 10 through a product outlet.

More specifically, product cleaner 10 includes a housing 12 including side opposing side walls 14 and opposing end walls 16. As shown in FIG. 1, one or more of the end walls 16 may include a transparent panel 18 so that the operation of the cleaner 10 can be readily observed. The transparent panel 18 may be made from any known transparent synthetic material, such as Lexan® synthetic material, which is manufactured by General Electric Company. Lexan® material is a clear, i.e., transparent, material that allows interior of the housing to be viewed from the outside during cleaning operations. Other transparent materials may also be used for the end panels. To facilitate their removal, end panels 60 are preferably attached by means of hand manipulable fasteners such as wing nuts or the like, thus alleviating the need for tools to remove the end panels. Generally, the transparent panel 18 will extend from the product inlet 20 located upward of the panel to the product outlet 22 located below the panel.

The product inlet or charging hopper 20 receives dirty product 24 from a product supply (not seen). As indicated by the downward directed arrow 26, in some cases the dirty product 24 will be falling downward from a product supply disposed thereover under the influence of gravity. It will be understood, however, that the product supply could be located laterally from the cleaner 10 and the dirty product could be brought to the product inlet 24 in any known manner, such as an auger system. The product inlet 24 will generally include some apparatus for controlling the flow of the dirty product 24 into the cleaner 10, such as a vane (not seen) on a rotatable shaft 28 that opens and closes the throat of the product inlet. Other known means for controlling the volume of product entering the product cleaner 10 may also be used with the present invention.

The product outlet 22 empties cleaned product 30 downwardly as indicated by arrow 32. The cleaned product 30 is typically received by a product transportation device such as a screw conveyor, though other means could also be used.

As the cleaned product 30 is discharged from the cleaner 10, the fines, dirt and other undesirable particles, hereafter collectively referred to as foreign materials, are discharged from the cleaner through a foreign materials discharge chute 34 as indicated by arrow 36.

It will be understood that the cleaner 10 encloses a separation plenum comprising an air inlet manifold 40 and an air outlet manifold 42 spaced apart from each other to form a cleaning chute 44. Air enters the cleaner 10 as indicated by arrows 46, flows through the air inlet manifold 40 as indicated by arrows 48, through the cleaning chute 44, through the air outlet manifold 42 as indicated by the arrows 50 and out of the cleaner 10 through the foreign material discharge chute 34, as indicated by the arrow 52. Air flow through the cleaner 10 is provided by a negative air pressure created at the foreign materials discharge chute 34 by a blower (not shown) or the like as is known in the prior art.

Desirably, the manifolds 40 and 42 can be removably disposed within the cleaner 10 in the manner shown in the Ackerman '434 patent, which as noted above is also assigned to the present assignee and which is incorporated herein by reference. Thus, the cleaner 10 may include includes a plurality of mounting rails 54 upon which the manifolds many be suspended in the manner shown in that patent. Alternatively, if desired, the manifolds may be permanently affixed within the cleaner 10. The inlet manifold 42 can be constructed substantially as described in the aforesaid Ackerman '434 patent. Generally, it will be understood that the inlet manifold includes a plurality of vertically extending ribs 56. Mounted to the ribs 56 are a plurality of louvers 58, which are spaced apart vertically along the ribs 56 to form air flow inlets 60. Each air inlet 60 comprises upper and lower lip panels or elements 62 and 64, respectively. Lip element 62 extends outwardly into the cleaning chute 44. Further detail regarding the construction of such louvers can be discerned from the aforementioned Ackerman '434 patent.

Control of the air flow through the cleaner 10 is partially provided by a damper 100 disposed on the foreign materials discharge chute 34. In addition, air flow control is provided by a plurality of flow control devices attached to the air outlet manifold 42 and to be described hereafter with reference to FIGS. 2–6.

The outlet manifold 42 comprises a plurality of upright extending ribs 102 and a plurality of longitudinally, that is, substantially horizontally extending louvers spaced vertically apart from each other along the upward extent of the ribs 102 substantially the entire length of the cleaner 10. Thus, as shown in the embodiment shown in the Figures, outlet manifold 42 includes ribs 102 and top louver 104, middle louvers 106, 108, and bottom louver 110. As with the inlet manifold 40, the spacing of the outlet louvers creates air outlets 112, thus cooperating with the louvers 58 to create a transverse air flow across the cleaning chute 44.

Figure 2:
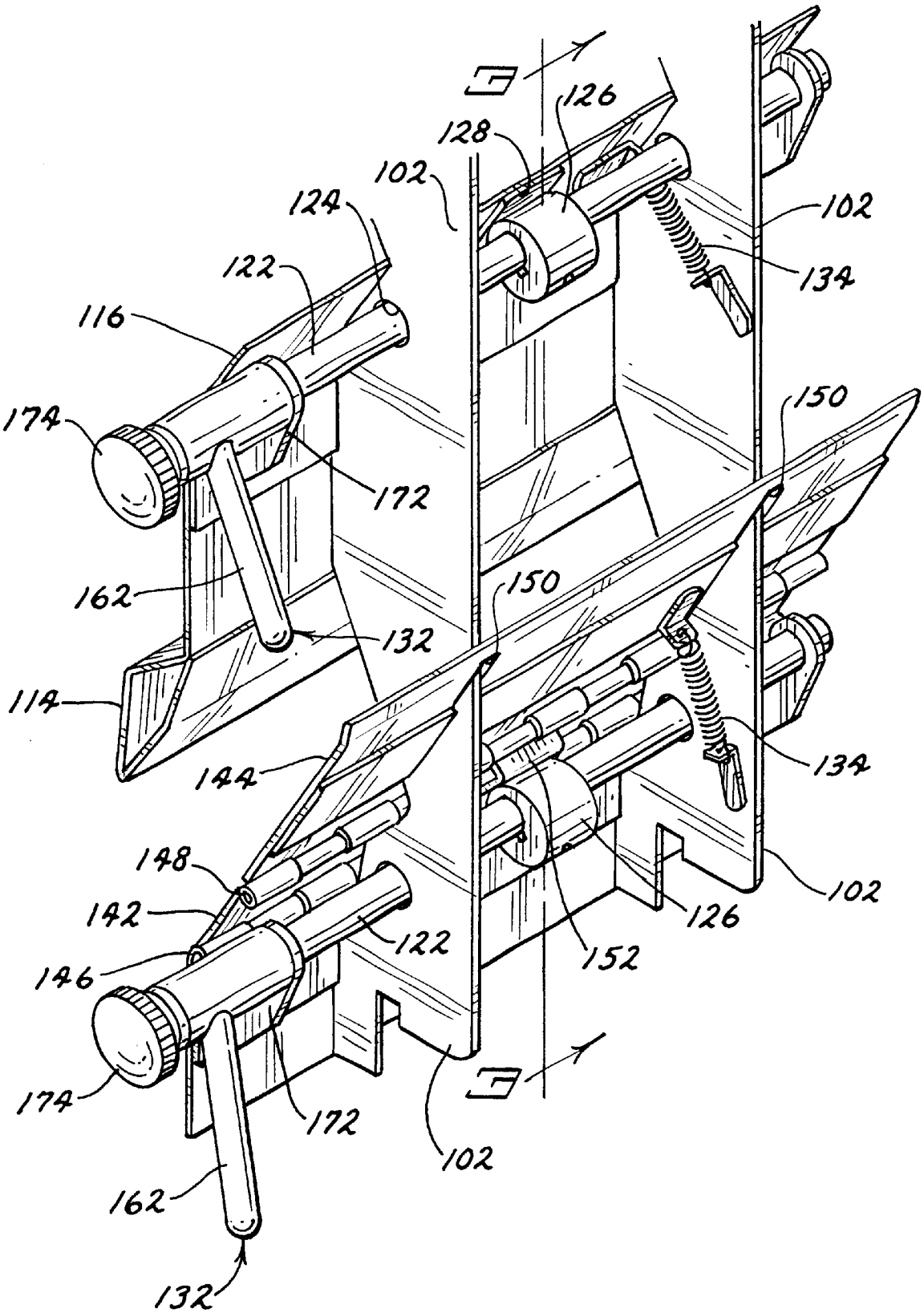
FIG. 2 is a perspective view of the damper controls in accord with the present invention.
Figure 3:
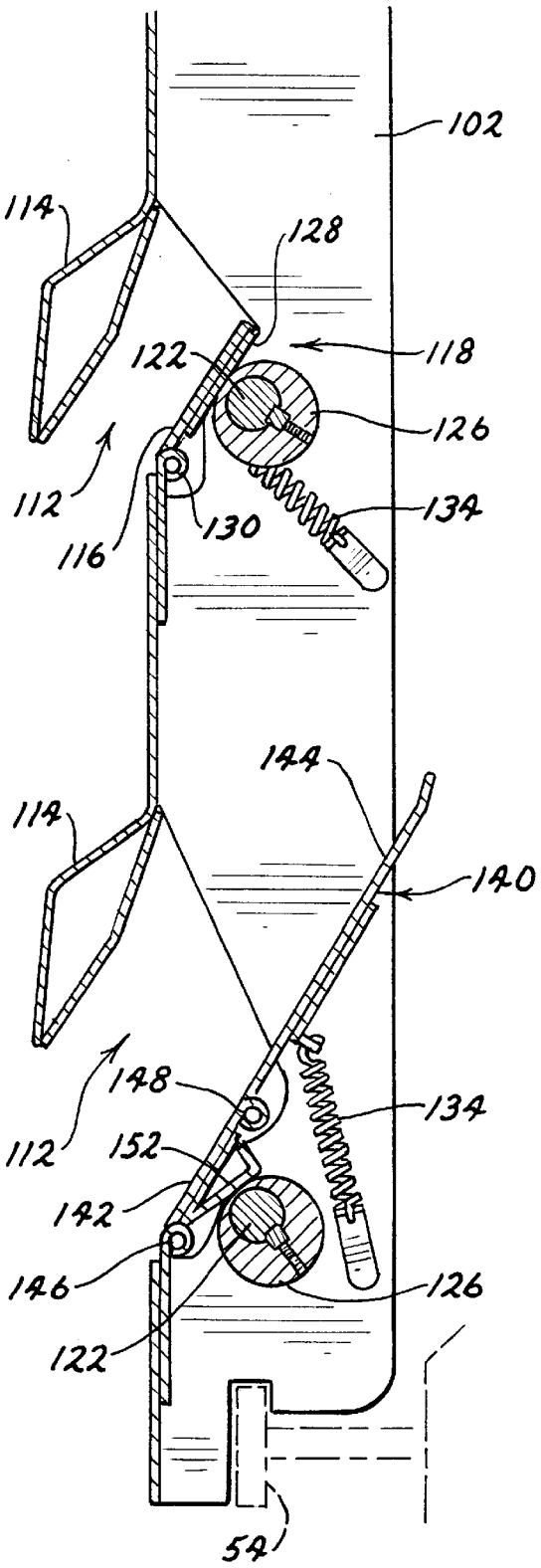
FIG. 3 is a cross sectional view taken along viewing plane 3—3 of FIG. 2 showing the dampers in an open position.
Figure 4:
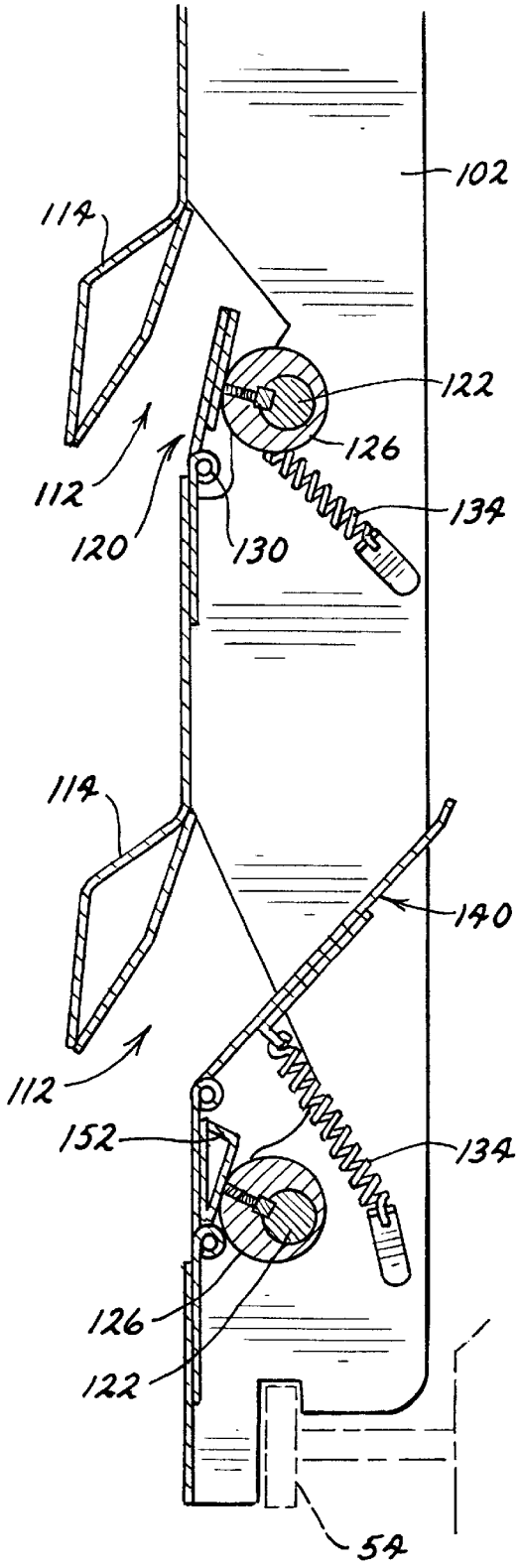
FIG. 4 is a cross sectional view showing the dampers in a closed position.
Figure 5:
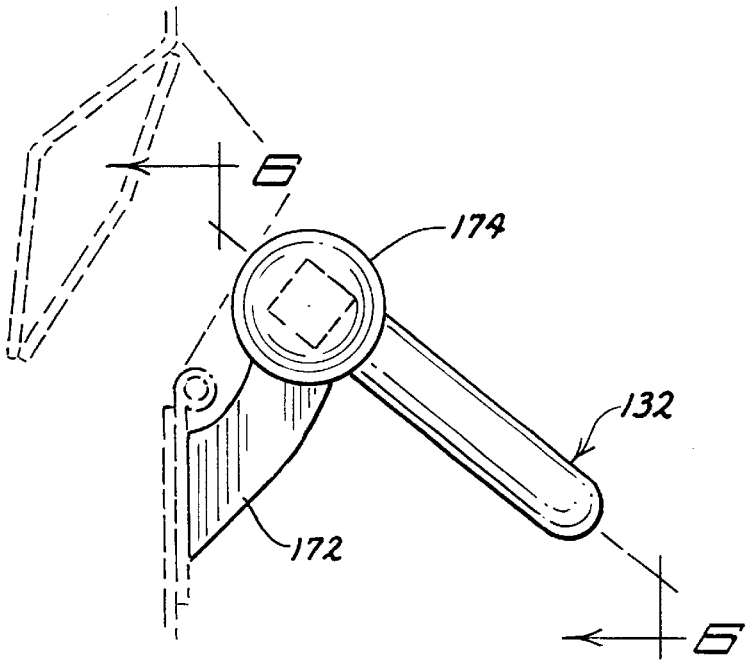
FIG. 5 is a side elevation view of a damper adjustment handle in accord with the present invention.
Figure 6:
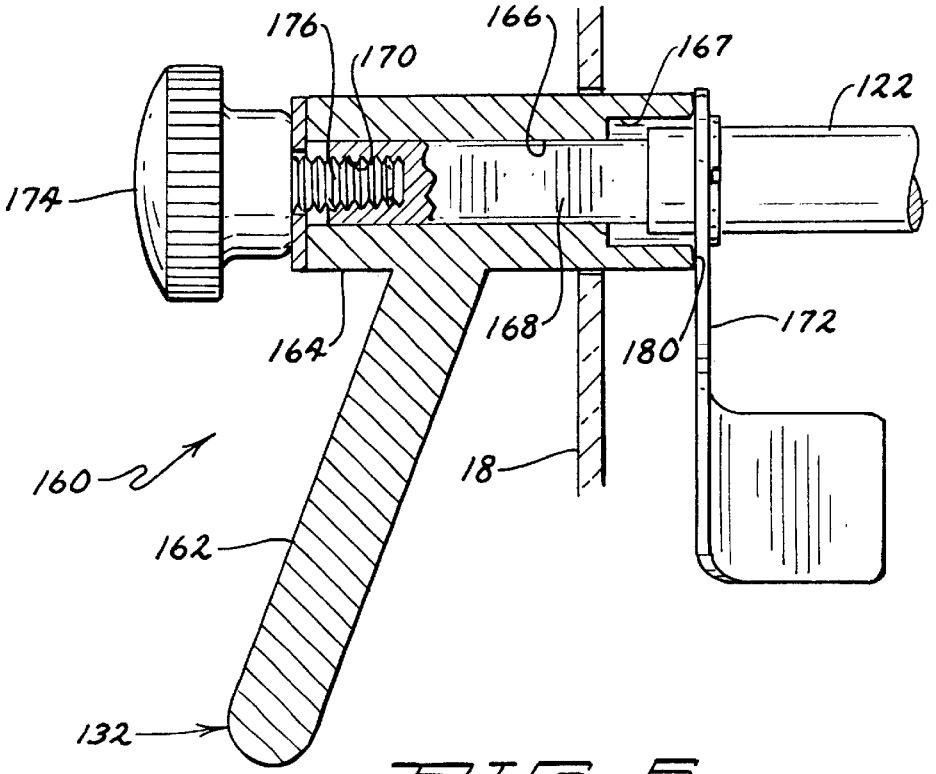
FIG. 6 is a cross sectional view of the handle shown in FIG. 5 taken along viewing plane 6—6 thereof.

Referring specifically to FIGS. 2–4, it will be understood that each of the air outlets 112 is defined by an upper lip 114 and a lower lip 116. The upper lips 114 of one louver and the lower lip 116 of the next adjacent louver therebelow define the air outlets 112 therebetween. The lower lip 112 is movable between open and closed positions 118 and 120, respectively, as seen by comparing FIGS. 2 and 4. Moving the lower lips 112, which thus function as dampers, enables the operator to control the flow of air through each of the air outlets individually, thus providing fine control over the air flow through the cleaner 10.

The apparatus used to provide movement to the lower lips 112 will now be described with particular reference to the upper air outlets. Cleaner 10, and particularly, outlet manifold 42 includes a plurality of adjustment shafts 122 extending the width of the manifold 42 closely adjacent each of the lover lips 112. The shafts 122 are rotatably received by shaft holes 124 in the ribs 102. Fixed to the shafts 122 are cams 126. The cams 126 engage cam wear plates 128, which are fixedly attached to the lips 116. The lower lips 116 are in turn each mounted for pivotal movement about a shaft 130. A handle 132 is attached to the shaft 122. Rotation of the handle 132 rotates the shaft 122, which in turn rotates the cams 126 and causes the lips 116 to pivot into the air outlets 112, thus constricting their cross sectional area and reducing the air flow therethrough.

A biasing means, such as a spring 134, is used to return the lips from the closed position shown in FIG. 4 to the open position. That is, as the handle 132 is rotated to close the air outlet 112, spring 134 is stretched, creating a return bias force. The spring 134 is attached at one end to the rib 102 at the other end to the lip 116.

The lowest air outlet 112 also includes a movable lip or damper. It differs from the air outlets thereabove as will be described below. Thus, the lowest air outlet includes a lower lip or damper 140 that is doubly pivotable. Thus, the lower damper 140 includes first and second hinged portions 142 and 144. The first portion 142 is pivotally hinged to a rod 146 at its lower end and to a rod 148 at its upper end. The second or upper portion 144 is pivotally hinged to the first portion by rod 148. Thus, the first and second portions are capable of pivoting to different angles relative to each other and the vertical. As seen in FIG. 3, the first and second portions have a substantially planar configuration when in the open position. When the lower damper 140 is moved to the closed position, the first portion is moved to a substantially upright or vertical position while the second portion remains angularly disposed relative to the vertical.

The damper 140, as best seen in FIG. 2, includes slots 150 that are configured to receive the ribs 102. It will be understood that the limits of movement of the damper 140 are defined in part by the length of the slot and the interference with the end of the slots and the ribs 102. That is, as the damper 140 is moved to the closed position seen in FIG. 4, The interference between the slots and the ribs will prevent further pivoting.

A cam wear plate 152 comprised of a right angle member is attached to the first or lower portion of the damper or lip 140. The right angle or L-shaped configuration of the cam wear plate 152 increases the range of motion of the damper 140 compared to the other lips.

It will be under stood that the phrases "open position" and "closed position" are used relative to each other and that when in the "closed" or constricted position the present invention still allows substantial air flow through the air outlets 112. That is, movement of the dampers in the air outlets constricts the size of the air flow path through the outlets.

Retention of the dampers in the desired position is provided by clamping handles 160. Thus, referring to FIGS. 5 and 6, each clamping handle 160 will include the handle 132 previously discussed. Handle 132 includes a gripping portion 162 attached to a cylindrical portion 164 having a bore 166 and a counter sunk bore 167. Bore 166 receives a shaft extension 168 affixed to the end of the shaft 122, with the wider diameter shaft being received by the countersunk bore portion 167 of the cylindrical portion 164. The shaft extension 168 includes a threaded hole 170. A washer 172 is attached to the end of the cylindrical portion 164. A locking knob 174 having a threaded shaft 176 is received by the threaded hole 178. As the knob 174 is turned, the knob 174 and the shaft extension 168, and hence the shaft 122 are pulled towards each other. This in turn causes the end 180 of the cylindrical portion 164 to bear against the bracket 172. Thus, to adjust the movable dampers, the knob 174 will be loosened, allowing the operator to rotate the handle 132 and thus the shaft 122, which is affixed thereto through the shaft extension 168. When the damper is in the desired position, the knob 174 will be tightened, cause the end 180 to frictionally engage the bracket 172, thereby retaining the damper in the desired location.

It will be understood that the present invention may also include a plurality of see through panels 190 and 192 located on the product discharge chute 22 and the foreign materials discharge chute 34. These panels 190 and 192 enable the operator to monitor the flow of air and materials through the cleaner 10.

The present invention, then, provides an apparatus for precisely controlling the airflow through a product cleaner. Providing the means for controlling the air flow through each of the outlets enables the operator to control the air flow by controlling the airflow across the downwardly falling product. That is, with the prior art, it was found that controlling the air flow on the inlet side allowed the operator to control the amount of air flowing into the cleaner, but that it did not enable the operator to precisely control where the air flow went after it entered the cleaner. With the present invention, the operator can control the volume of air flowing through each of the outlets, which in turn enables the operator to control with more precision the transverse airflows. This greater control in turn improves the ability of the cleaner to remove foreign material from the product.

The present invention having thus been described, other modifications, alterations, or substitutions may now suggest themselves to those skilled in the art, all of which are within the spirit and scope of the present invention. It is therefore intended that the present invention be limited only by the scope of the attached claims below.

What is claimed is:

1. A product cleaner for separating fines and/or foreign matter from dry, free-flowing, granular product, said product cleaner comprising:

a housing;

a charging hopper;

a discharge for conducting said granular material from said product cleaner, said discharge disposed beneath said charging hopper;

an air inlet manifold;

an air outlet manifold, said air outlet manifold being spaced apart from said air inlet manifold; and a separation plenum formed by said spaced apart air inlet and air outlet manifolds, said manifolds extending vertically downwardly from said charging hopper to said discharge, said separation plenum adapted to communicate with said charging hopper and said discharge to thereby conduct product from said charging hopper downwardly to said discharge, said air inlet manifold comprising a plurality of air inlets and said air outlet manifold comprising a plurality of air outlets and wherein at least one of said air outlets of said air outlet manifold comprises a damper movable between open and constricted positions so that the airflow therethrough can be controlled.

2. The product cleaner of claim 1 wherein at least one of said manifolds comprises:

first and second rib members extending substantially parallel to each other; and at least a pair of spaced apart, elongate louvers defining therebetween an air flow path communicating with said separation plenum.

3. The product cleaner of claim 1 wherein said air outlet manifold comprises a plurality of vertically-spaced air inlets.

4. The product cleaner of claim 3 wherein each of said air outlets of said air outlet manifold are disposed substantially opposite to and above its respective air inlet.

5. The product cleaner of claim 1 wherein said manifolds each comprise a pair of ribs extending substantially vertically and said inlets and outlets are defined by a plurality of louvers attached to said ribs.

6. The product cleaner of claim 5 wherein said damper of said at least one air outlet of said air outlet manifold comprises a lip panel pivotally attached to said ribs and means for moving said lip panel between open and constricted positions relative to said louvers forming said at least one air outlet.

7. The product cleaner of claim 6 wherein said means for moving comprises a rotatable cam bearing against said lip panel and wherein rotation of said cam moves said lip panel between said open and constricted positions.

8. The product cleaner of claim 7 wherein said means for moving further includes a biasing means for biasing said lip panel to said open position.

9. The product cleaner of claim 8 wherein said biasing means comprises a spring.

10. The product cleaner of claim 7 wherein said means for moving further comprises a shaft rotatably received by said ribs and wherein said cam is affixed to said shaft.

* * * * *